US007976289B2

(12) United States Patent
Masao

(10) Patent No.: US 7,976,289 B2
(45) Date of Patent: Jul. 12, 2011

(54) CAPACITY VARIABLE TYPE ROTARY COMPRESSOR AND DRIVING METHOD THEREOF

(75) Inventor: Ozu Masao, Fuji (JP)

(73) Assignee: LG Electronics Inc., Seoul (KR)

( * ) Notice: Subject to any disclaimer, the term of this patent is extended or adjusted under 35 U.S.C. 154(b) by 1142 days.

(21) Appl. No.: 11/659,325

(22) PCT Filed: Aug. 4, 2005

(86) PCT No.: PCT/KR2005/002544

§ 371 (c)(1),
(2), (4) Date: Feb. 5, 2007

(87) PCT Pub. No.: WO2006/014086

PCT Pub. Date: Feb. 9, 2006

(65) Prior Publication Data

US 2008/0307809 A1 Dec. 18, 2008

(30) Foreign Application Priority Data

Aug. 6, 2004 (KR) ..... 10-2004-0062099

(51) Int. Cl.
*F04B 53/00* (2006.01)

(52) U.S. Cl. ..... 417/310

(58) Field of Classification Search ..... 62/196.4, 62/196.1; 418/54, 65; 417/310
See application file for complete search history.

(56) References Cited

U.S. PATENT DOCUMENTS 2,976,701 A * 3/1961 Greenawalt ..... 62/324.6
4,137,726 A * 2/1979 Watada ..... 62/196.3
4,326,868 A * 4/1982 Ozu et al. ..... 62/324.6
4,335,582 A * 6/1982 Shaw et al. ..... 62/196.1
4,373,352 A * 2/1983 Ladusaw ..... 62/196.4
4,558,993 A * 12/1985 Hori et al. ..... 417/283
4,583,373 A * 4/1986 Shaw ..... 62/196.3
4,762,469 A * 8/1988 Tischer ..... 417/279
4,805,666 A * 2/1989 Araki et al. ..... 137/625.43
4,889,474 A * 12/1989 Nakajima et al. ..... 417/295
4,890,986 A * 1/1990 Taguchi et al. ..... 417/295
4,892,466 A * 1/1990 Taguchi et al. ..... 417/295
5,030,066 A * 7/1991 Aihara et al. ..... 417/295
5,074,761 A * 12/1991 Hirooka et al. ..... 417/310
5,167,491 A * 12/1992 Keller et al. ..... 417/28

(Continued)

FOREIGN PATENT DOCUMENTS

EP 0354867 2/1990

(Continued)

*Primary Examiner* — Alexander B Comley
(74) *Attorney, Agent, or Firm* — KED & Associates LLP

(57) ABSTRACT

A capacity variable type rotary compressor and a driving method thereof are provided. The compressor includes bypass holes that connect a compression chamber and a suction chamber of a cylinder divided from each other by a vane formed at a sub bearing, a sliding valve that opens and closes bypass holes installed at the sub bearing, and a pressure difference maintaining device that enables the sliding valve to perform a capacity exclusion driving, thereby lowering a cooling capability at the time of the capacity exclusion driving. By maintaining the capacity exclusion driving for a long time, an air conditioner is variously controlled and unnecessary power waste of the compressor and the air conditioner to which the compressor is applied is decreased. A back pressure of the sliding valve is fast and precisely switched by a pilot valve having a high reliability, so that the compressor is widely applied to an air conditioner thereby to enhance the efficiency thereof.

11 Claims, 9 Drawing Sheets

U.S. PATENT DOCUMENTS

| | | | | |
|---|---|---|---|---|
| 6,089,830 | A * | 7/2000 | Harte et al. | 417/253 |
| 6,336,800 | B1 * | 1/2002 | Kim et al. | 418/63 |
| 6,474,082 | B2 * | 11/2002 | Flynn | 62/129 |
| 6,551,069 | B2 * | 4/2003 | Narney et al. | 417/53 |
| 6,616,419 | B2 * | 9/2003 | Watanabe et al. | 417/220 |
| 6,663,358 | B2 * | 12/2003 | Loprete et al. | 417/313 |
| 6,830,073 | B2 * | 12/2004 | Lee | 137/625.43 |
| 6,892,548 | B2 * | 5/2005 | Choi et al. | 62/196.1 |
| 2004/0129017 | A1 * | 7/2004 | Choi et al. | 62/505 |
| 2005/0147499 | A1 * | 7/2005 | Weng | 417/44.11 |
| 2005/0193734 | A1 * | 9/2005 | Iwanami et al. | 60/657 |

FOREIGN PATENT DOCUMENTS

| | | |
|---|---|---|
| JP | 62045993 | 2/1987 |
| JP | 01155163 | 6/1989 |
| JP | 04094495 | 3/1992 |

* cited by examiner

CAPACITY VARIABLE TYPE ROTARY COMPRESSOR AND DRIVING METHOD THEREOF

TECHNICAL FIELD

The present invention relates to a capacity variable type rotary compressor, and more particularly, to a capacity variable type rotary compressor capable of controlling a cooling capability by properly discharging refrigerant gas of a compression chamber, and a driving method thereof.

BACKGROUND ART

A rotary compressor is mainly applied to an air conditioner. Recently, as the air conditioner has various functions, a capacity variable type rotary compressor is being required.

As technique for varying a capacity of the rotary compressor, an inverter method for controlling an rpm of the rotary compressor by applying an inverter motor has been well known. However, the technique has the following disadvantages. First, since the inverter motor is expensive, a fabrication cost is increased. Second, since the air conditioner is used as a cooling apparatus, a process for enhancing a cooling capability in a cooling condition is more difficult than a process for enhancing a cooling capability in a heating condition.

Accordingly, recently, a cooling capability varying technique by an exclusion capacity switching (hereinafter, will be called as an exclusion capacity switching technique) for varying a capacity of a compression chamber by bypassing a part of refrigerant gas compressed in a cylinder outside the cylinder is being introduced instead of the inverter method.

As the exclusion capacity switching technique, a digital compression technique for controlling a cooling capability by combining a saving driving (hereinafter, 'mode 0 driving') for making a cooling capability be zero by temporarily stopping a compressor being operated with a power driving (hereinafter, 'mode 1 driving') for driving a compressor with 100% is being introduced.

For example, if the mode 1 driving is performed for 7 seconds and the mode 0 driving is performed for 3 seconds, a cooling capability corresponding to 70% is obtained for the total 10 seconds. A compressor for controlling a cooling capability by controlling the mode 1 driving and the mode 0 driving by time is called as a digital compressor. The digital compressor can be fabricated with a cheap cost since an inverter is not required, and has an excellent efficiency and reliability.

However, most of the digital compression techniques have not been applied to a concrete driving mechanism of a rotary compressor, whereas the digital compression technique has been applied to a scroll compressor for utility.

DISCLOSURE OF THE INVENTION

Therefore, an object of the present invention is to provide a capacity variable type rotary compressor having a practical mechanism based on a digital compression technique and a driving method thereof.

To achieve these and other advantages and in accordance with the purpose of the present invention, as embodied and broadly described herein, there is provided a capacity variable type rotary compressor, comprising: a casing having a gas suction pipe connected to an evaporator and a gas discharge pipe connected to a condenser; a cylinder fixed in the casing, having an inner space at a center thereof for compressing a refrigerant as a rolling piston performs an orbit motion, having an inlet penetratingly formed at the inner space in a radial direction to be connected to the gas suction pipe, and having a vane slit in a radial direction, the vane slit for supporting a vane that divides the inner space into a compression chamber and a suction chamber by contacting the rolling piston in a radial direction; a plurality of bearing plates for covering upper and lower sides of the cylinder and thereby sealing the inner space, having a discharge opening provided with a discharge valve connected to the inner space of the cylinder for discharging a compressed refrigerant at one bearing plate, having a plurality of bypass holes for inserting the vane and connecting the compression chamber and the suction chamber of the cylinder divided from each other by the vane at another bearing plate; a capacity varying unit coupled to the bearing plate for selectively connecting the bypass holes formed at both sides of the bearing plate and thereby bypassing a part of a compressed refrigerant to the inlet; and a back pressure switching unit for differently supplying a back pressure to the capacity varying unit so that the capacity varying unit can open or close the bypass holes according to a driving mode of the compressor.

According to another embodiment, the capacity variable type rotary compressor comprises: a casing having a gas suction pipe connected to an evaporator and a gas discharge pipe connected to a condenser; a cylinder fixed in the casing, having an inner space at a center thereof for compressing a refrigerant as a rolling piston performs an orbit motion, having an inlet penetratingly formed at the inner space in a radial direction to be connected to the gas suction pipe, and having a vane slit in a radial direction, the vane for supporting a vane that divides the inner space into a compression chamber and a suction chamber by contacting the rolling piston in a radial direction; a plurality of bearing plates for covering upper and lower sides of the cylinder and thereby sealing the inner space, having a discharge port provided with a discharge valve connected to the inner space of the cylinder for discharging a compressed refrigerant at one bearing plate, having a plurality of bypass holes for inserting the vane and connecting the compression chamber and the suction chamber of the cylinder divided from each other by the vane at another bearing plate; a capacity varying unit coupled to the bearing plate for selectively connecting the bypass holes formed at both sides of the bearing plate and thereby bypassing a part of a compressed refrigerant to the inlet; a back pressure switching unit for differently supplying a back pressure to the capacity varying unit so that the capacity varying unit can open or close the bypass holes according to a driving mode of the compressor; and a pressure difference maintaining unit for forcibly controlling a refrigerant flow so that an opened/closed state of the capacity varying unit can be maintained for a certain time.

To achieve these and other advantages and in accordance with the purpose of the present invention, as embodied and broadly described herein, there is also provided a method for driving a capacity variable type rotary compressor, comprising consecutively performing a power driving mode for implementing a maximum cooling capability by driving the rotary compressor under a state that a capacity varying unit closes bypass holes, and a saving driving mode for excluding an entire compressed refrigerant of a cylinder to a suction chamber of the cylinder as the capacity varying unit connects the bypass holes one another by a back pressure switching unit when a lowering of a cooling capability is required while the power driving mode is performed.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

MODES FOR CARRYING OUT THE PREFERRED EMBODIMENTS

Reference will now be made in detail to the preferred embodiments of the present invention, examples of which are illustrated in the accompanying drawings.

Hereinafter, a capacity variable type rotary compressor and a driving method thereof according to the present invention will be explained in more detail with reference to one embodiment of the attached drawings.

Figure 1:
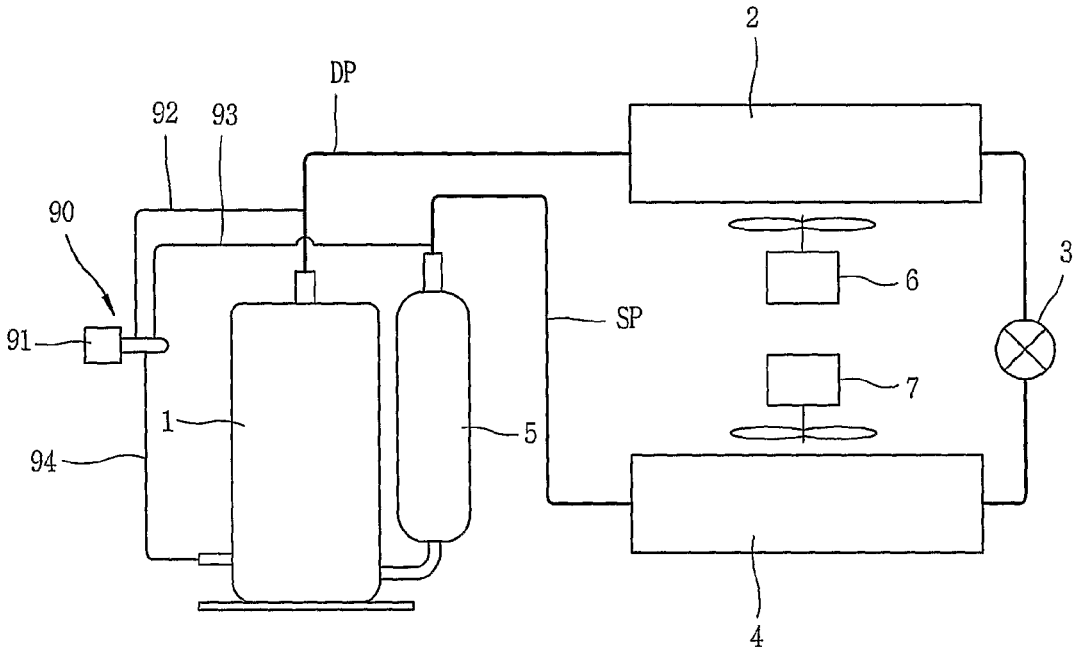
FIG. 1 is a piping diagram showing an air conditioner having a capacity variable type rotary compressor according to the present invention.
Figure 2:
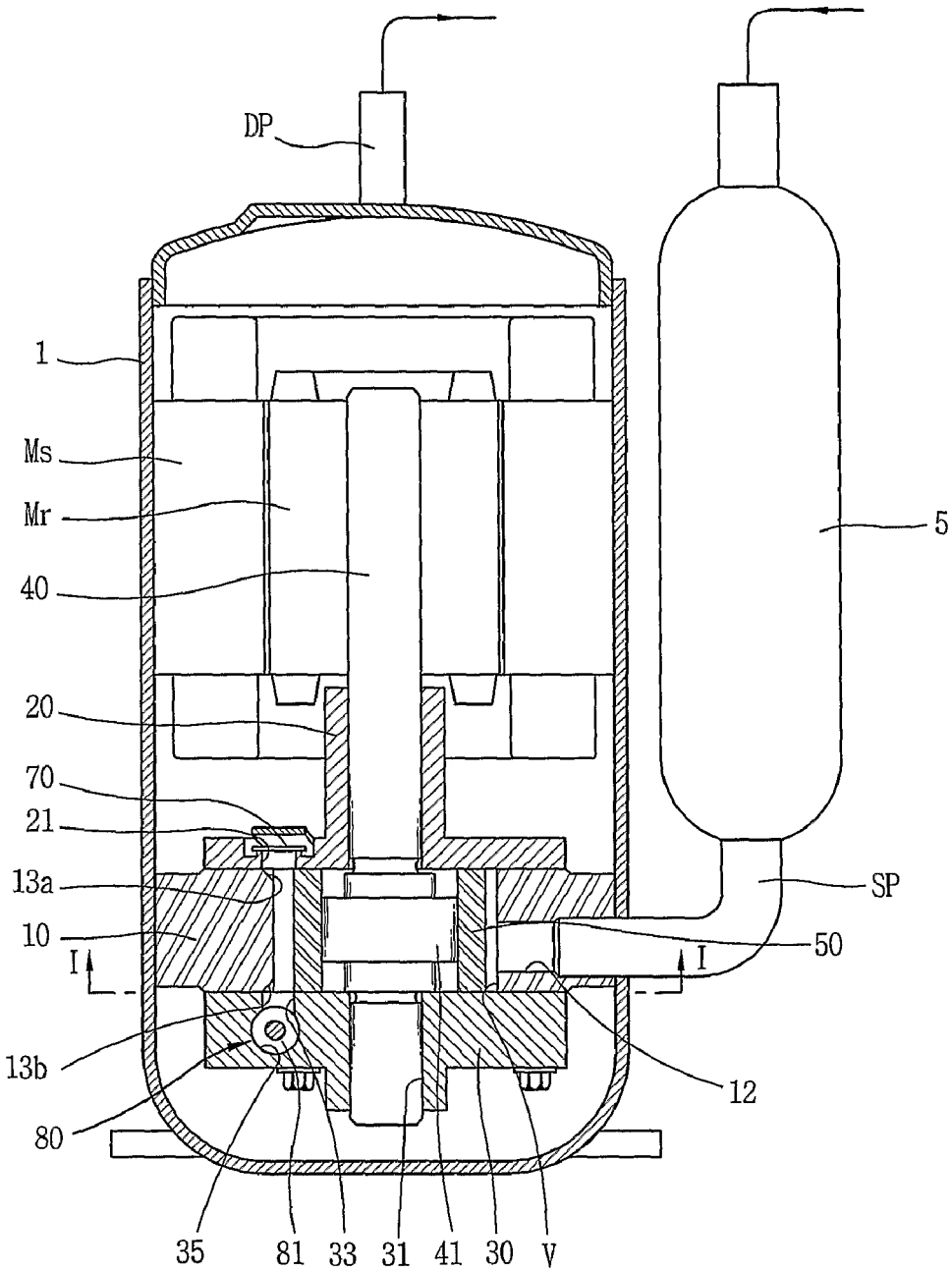
FIG. 2 is a sectional view taken along line II-II in FIG. 3, which shows one embodiment of the capacity variable type rotary compressor according to the present invention.
Figure 3:
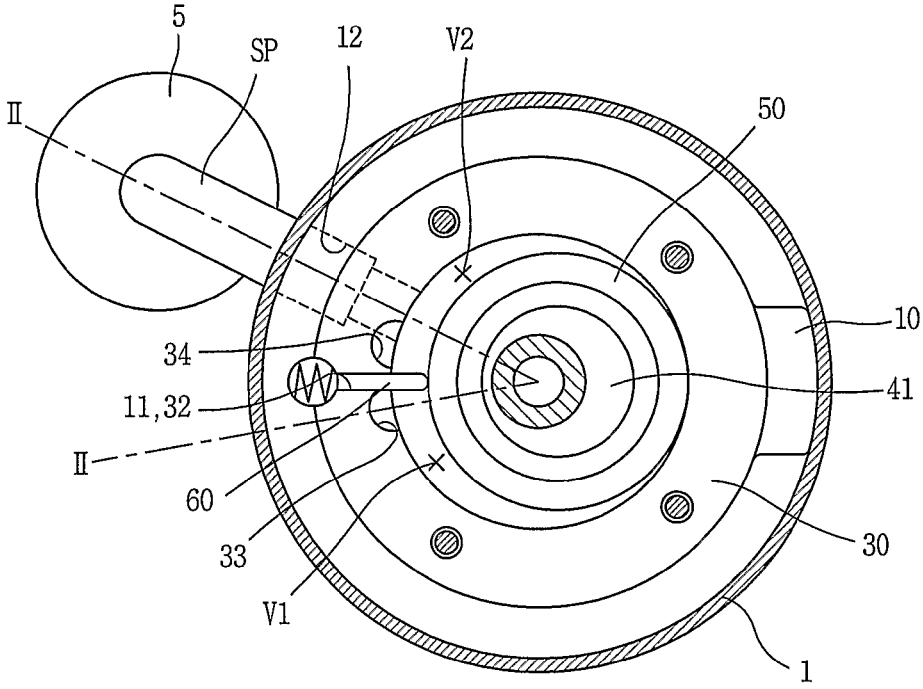
FIG. 3 is a sectional view taken along line I-I in FIG. 2.
Figure 4:
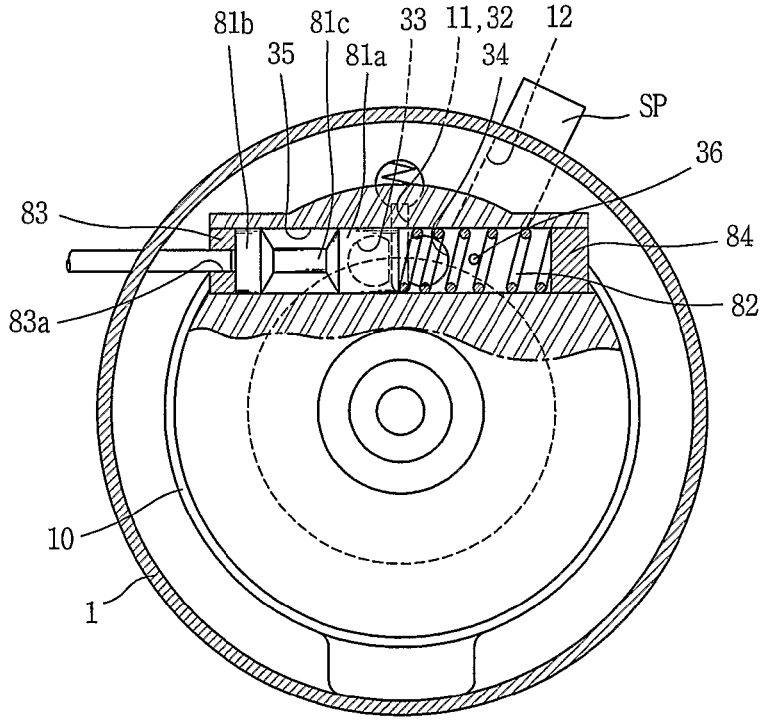
FIG. 4 is a sectional view showing a capacity varying unit of the capacity variable type rotary compressor according to the present invention.
Figure 5:
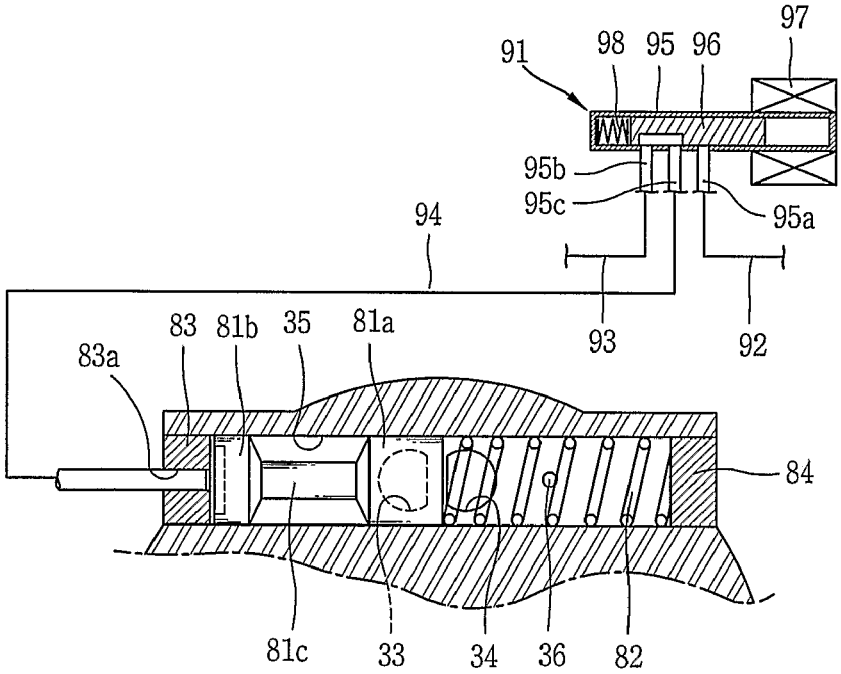
FIGS. 5 and 6 are sectional views respectively showing a power driving and a saving driving in the capacity variable type rotary compressor according to the present invention.
Figure 6:
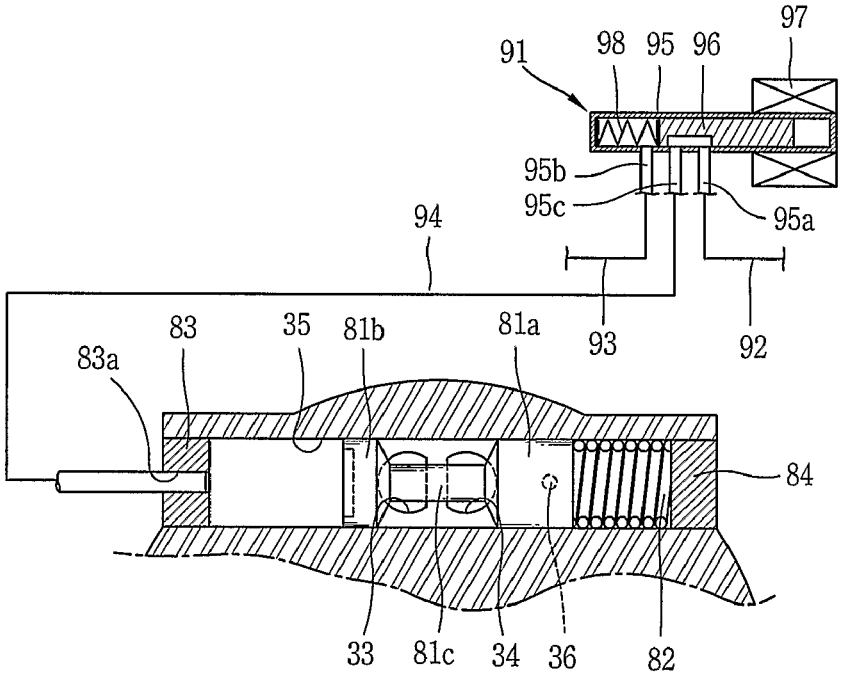

FIG. 1 is a piping diagram showing an air conditioner having a capacity variable type rotary compressor according to the present invention, FIG. 2 is a sectional view taken along line II-II in FIG. 3, which shows one embodiment of the capacity variable type rotary compressor according to the present invention, FIG. 3 is a sectional view taken along line I-I in FIG. 2, FIG. 4 is a sectional view showing a capacity varying unit of the capacity variable type rotary compressor according to the present invention, and FIGS. 5 and 6 are sectional views respectively showing a power driving and a saving driving in the capacity variable type rotary compressor according to the present invention.

As shown, the rotary compressor according to the present invention comprises a casing 1 to which a gas suction pipe SP and a gas, discharge pipe DP are connected, a motor unit installed at an upper side of the casing 1 for generating a rotation force, and a compression unit installed at a lower side of the casing 1 for compressing a refrigerant by the rotation force generated from the motor unit.

The motor unit is composed of a stator Ms fixed in the casing 1 and receiving a power applied from outside, and a rotor Mr arranged in the stator Ms with a certain air gap and rotated while reciprocally operated with the stator Ms.

The compression unit comprises a cylinder 10 having a ring shape and installed in the casing 1, a main bearing plate (hereinafter, will be called as a main bearing) 20 and a sub bearing plate (hereinafter, will be called as a sub bearing) 30 for covering upper and lower sides of the cylinder 10 and thereby forming an inner space V, a rotation shaft 40 inserted into the rotor Mr and supported by the main bearing 20 and the sub bearing 30 for transmitting a rotation force, a rolling piston 50 rotatably coupled to an eccentric portion 41 of the rotation shaft 40 and performing an orbit motion at the inner space of the cylinder 10 for compressing a refrigerant, a vane 60 coupled to the cylinder 10 to be movable in a radial direction so as to contact an outer circumferential surface of the rolling piston 50 for dividing the inner space V of the cylinder 10 into a suction chamber and a compression chamber, and a discharge valve 70 coupled to an end of a discharge hole 21 of the main bearing 20 to be opened and closed.

The compression unit further comprises a capacity varying unit 80 provided at one side of the sub bearing 30 for varying a capacity of the compression chamber, and a back pressure switching unit 90 connected to the capacity varying unit 80 for operating the capacity varying unit 80 by a pressure difference according to a driving mode of the compressor.

The cylinder 10 is formed as a ring shape so that the rolling piston 50 can perform a relative motion, and a vane slit 11 is formed at one side of the cylinder 10 as a linear shape so that the vane 60 can perform a linear motion in a radial direction. Also, an inlet 12 connected to the gas suction pipe SP is penetratingly formed in a radial direction of the cylinder at one side of the vane slit 11.

The sub bearing 30 is formed as a disc shape that a bearing hole 31 for supporting the rotation shaft in a radial direction is formed at the center thereof. Also, a vane inserting groove 32 for partially inserting a lower end of the vane 60 is formed at a part facing the vane slit 11 of the cylinder 10 with the same shape as the vane slit 11. A plurality of bypass holes 33 and 34 respectively connected to the compression chamber V1 and the suction chamber V2 of the cylinder 10 are formed at both sides in a circumferential direction of the vane inserting groove 32. A valve hole 35 for slidably inserting a sliding valve 81 of the capacity varying unit 80 that will be later explained so as to connect the bypass holes 33 and 34 one another is formed in the sub bearing 30 in a direction perpendicular to the vane slit 11 or the vane inserting groove 32 at the time of a plane projection.

The bypass holes 33 and 34 are formed to be approximately parallel with the rotation shaft. One of the bypass holes 33 (hereinafter, will be called as a high pressure side bypass hole) is formed to be approximately equal to the discharge hole 21 of the main bearing 20, a maximum pressure angle. On the contrary, one of the bypass holes 34 (hereinafter, will be called as a low pressure side bypass hole) is formed to be partially overlapped with the inlet 12 at the time of a plane projection. Preferably, gas guiding grooves 13*a* and 13*b* are formed as a taper shape at lateral portions of the vane 60 of an inner circumferential surface of the cylinder 10 in order to smoothly flow gas to the bypass holes 33 and 34.

The valve hole 35 is penetratingly formed at an outer circumferential surface of the sub bearing 30 to connect the bypass holes 33 and 34 to each other in a direction approximately perpendicular to the vane slit 11 or the vane inserting groove 32. Also, two opened sides of the valve hole 35 are sealed by valve stoppers 83 and 84, respectively. A pressure equalizing hole 36 connected to the inlet 12 is formed at a circumferential surface of a space where the low pressure side bypass hole 34 is formed.

As shown in FIG. 4, the capacity varying unit 80 comprises a sliding valve 81 slidably inserted into the valve hole 35 and moved in the valve hole 35 by a pressure difference due to the back pressure switching unit 90 for opening and closing the bypass holes 33 and 34, at least one valve spring 82 formed of a compression spring for elastically supporting a motion direction of the sliding valve 81 and moving the sliding valve 81 in a position to close the bypass holes 33 and 34 when both ends of the valve spring have the same pressure, and a plurality of valve stoppers 83 and 84 for closing both ends of the valve hole 35 in order to prevent the sliding valve 81 from being separated from the valve hole 35.

The sliding valve 81 comprises a first pressure unit 81*a* slidably contacting an inner circumferential surface of the valve hole 35 and positioned at the low pressure side of the valve hole 35 for closing the bypass holes 33 and 34 by receiving a pressure from the back pressure switching unit 90, a second pressure unit 81*b* slidably contacting an inner circumferential surface of the valve hole 35 and positioned at the high pressure side of the valve hole 35 for closing the bypass holes 33 and 34 by receiving a pressure from the back pressure switching unit 90, and a connection unit 81*c* for connecting the two pressure units 81*a* and 81*b* and having a gas passage that connects the bypass holes 33 and 34 between an outer circumferential surface thereof and the valve hole 35.

The first pressure unit 81*a* is formed to be longer than each diameter of the bypass holes 33 and 34. Preferably, a spring fixing groove (not shown) for inserting the valve spring 82 is formed at a rear end of the first pressure unit 81*a* towards the center of the first pressure unit 81*a* in order to minimize a valve length.

A back pressure hole 83*a* for passing a common connection pipe 94 of the back pressure switching unit 90 that will be later explained is formed at the center of the valve stopper 83 to which the high pressure side bypass hole 33 belongs.

As shown in FIGS. 5 and 6, the back pressure switching unit 90 comprises a switching valve assembly 91 for determining a pressure of the pressure unit of the sliding valve 81, a high pressure connection pipe 92 connected to a high pressure side inlet 95*a* of the switching valve assembly 91 for providing a high pressure atmosphere, a low pressure connection pipe 93 connected to a low pressure side inlet 91*b* of the switching valve assembly 91 for providing a low pressure atmosphere, and a common connection pipe 94 for selectively supplying a high pressure atmosphere or a low pressure atmosphere to the second pressure unit 81*b* of the sliding valve 81 by connecting a common side outlet 95*c* of the switching valve assembly 91 to the back pressure hole 83*a* of the valve stopper 83.

The switching valve assembly 91 comprises a switching valve housing 95 for forming the high pressure side inlet 95*a*, the low pressure side inlet 95*b*, and the common side outlet 95*c*, a switching valve 96 slidably coupled to inside of the switching valve housing 95 for selectively connecting the high pressure side inlet 95*a* and the common side outlet 95*c* or the low pressure side inlet 95*b* and the common side outlet 95*c*, an electromagnet 97 installed at one side of the switching valve housing 95 for moving the switching valve 96 by an applied power, and a switching valve spring 98 for restoring the switching valve 96 when the power applied to the electromagnet 97 is cut off.

Preferably, the electromagnet 97 has a small size and requires a consumption power less than approximately 15 Watt/Hour in order to enhance a reliability and to reduce a fabrication cost and a consumption power.

An inlet of the high pressure connection pipe 92 may be connected to a middle part of the gas discharge pipe DP. However, the high pressure connection pipe 92 is preferably connected to a lower portion of the casing 1 in order to be soaked in oil filled in the casing 1, thereby introducing the oil between inside of the switching valve assembly 91 or the valve hole 35 and the sliding valve 81 and thereby preventing a frictional loss or a gas leakage.

The common connection pipe 94 is preferably formed of a tubule such as a capillary tube, etc. to smoothly perform a pressure switching, thereby reducing vibration and noise of the compressor.

An unexplained reference numeral 2 denotes a condenser, 3 denotes an expander, 4 denotes evaporator, 5 denotes an accumulator, 6 denotes a condenser blowing fan, 7 denotes an evaporator blowing fan, and 13*a* denotes a gas guiding groove.

An operation of the capacity variable type rotary compressor according to the present invention will be explained as follows.

When power is supplied to we motor unit, the rotation shaft 40 is rotated and the rolling piston 50 performs an orbit motion at the inner space V of the cylinder 10 thereby to form a cavity between the vane 60. The rolling piston 50 sucks a refrigerant into the cavity, compresses the refrigerant, and then discharges the refrigerant into the casing 1. The refrigerant gas is discharged to the condenser 2 of the refrigerating cycle apparatus through the gas discharge pipe DP, then sequentially passes through the expander 3 and the evaporator 4, and then is sucked into the inner space V of the cylinder 10 through the gas suction pipe SP, which is repeated.

The capacity variable type rotary compressor performs a mode 0 driving (a saving driving) or a mode 1 driving (power driving) according to a driving state of an air conditioner to which the capacity variable type rotary compressor is applied, which will be explained in more detail as follows.

In case of the mode 1 driving, as shown in FIG. 5, power applied to the electromagnet 97 of the back pressure switching unit 90, a pilot valve is turned off and the switching valve 96 is moved by an elastic force of the switching valve spring 98, thereby connecting the low pressure side outlet 95*b* to the common connection pipe 95*c*. Accordingly, while the compressor is operated, a refrigerant gas of a low pressure that has passed through the gas suction pipe SP or the evaporator 4 is introduced into the second pressure unit 81*b* of the sliding valve 81 via the low pressure connection pipe 93 and the common connection pipe 94. The switching valve 96 is moved to the left side of the drawing by the elastic spring of the switching valve spring 98 that supports the first pressure unit 81*a*, so that the first pressure unit 81*a* closes the high pressure side bypass hole 33. As the high pressure side bypass hole 33 is closed, the refrigerant gas compressed in the compression chamber V1 of the cylinder 10 is discharged into the casing 1 via the discharge hole 21 of the main bearing 20 and then circulates the condenser 2, the expander 3, and the evaporator 4, thereby performing a compression driving for implementing a cooling capability of 100%.

On the contrary, in case of the mode 0 driving, as shown in FIG. 6, the power applied to the electromagnet 97 of the back pressure switching unit 90, a pilot valve is turned on and the switching valve 96 is moved by overcoming the elastic force of the switching valve spring 98, thereby connecting the high pressure side outlet 95*a* to the common connection pipe 95*c*. Accordingly, while the compressor is operated, a refrigerant gas of a high pressure inside the gas discharge pipe DP or the casing 1 is introduced into the second pressure unit Bib of the sliding valve 81 via the low pressure connection pipe 93 and the common connection pipe 94. As the second pressure unit 81*b* has a high pressure atmosphere, the switching valve 96 moves to the right side of the drawing by overcoming the elastic force of the switching valve spring 98. Accordingly, the connection unit 81*c* of the sliding valve 81 is positioned between the high pressure side bypass hole 33 and the low pressure side bypass hole 34, thereby connecting the bypass holes 33 and 34 to each other. The refrigerant gas compressed in the compression chamber V1 of the cylinder 10 is moved to the suction chamber V2 of the cylinder 10 which has a relatively low pressure as the high pressure side bypass hole 33 is opened, and a part of the refrigerant gas backflows to the inlet 12 through the pressure equalizing hole 36. Accordingly, the compressor performs a non-compression driving having a cooling capability of 0%.

When the compressor is to be stopped, the compressor can be stopped in the mode 1 driving or the mode 0 driving. Since the mode 1 driving is a compression driving and the mode 0 driving is a non-compression driving, the compressor is preferably stopped in the mode 0 driving in order to reduce vibration of the compressor. As the high pressure side and the low pressure side of the valve hole 35 have the same pressure, the sliding valve 81 returns to the state of FIG. 5 by the valve spring 82.

Also, the compressor is preferably operated in the mode 0 driving in order to reduce vibration thereof. At the time of switching the compressor into the mode 1 driving, the compressor can be easily switched into the mode 1 driving since the compressor is being accelerated. Accordingly, the compressor is preferably operated in the mode 0 driving in order to facilitate the driving and to prevent the compressor from being mal-functioned due to a drastic suction of a liquid refrigerant. However, in case that a long time (generally, more than one minute) elapses after stopping the compressor, a pressure difference between the high pressure side and the low pressure side for maintaining the mode 0 driving is not generated and thereby the compressor has to be operated in the mode 1 driving like a general compressor. Therefore, if the mode 0 driving can be performed for a long time and the switching of the mode 1 driving into the mode 0 driving can be fast and easily performed, an air conditioner to which the capacity variable type rotary compressor is applied can be operated more variously.

To this end, a capacity variable type rotary compressor having a pressure difference maintaining unit is considered.

Figure 7:
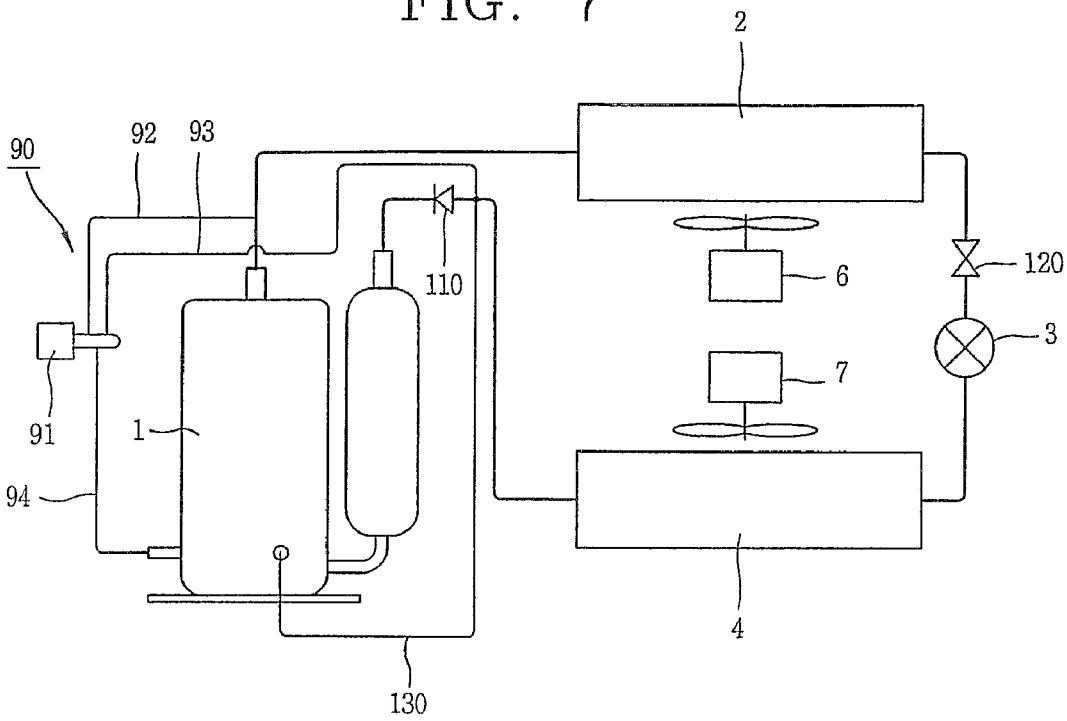
FIG. 7 is a piping diagram showing another embodiment of the capacity variable type rotary compressor according to the present invention.
Figure 8:
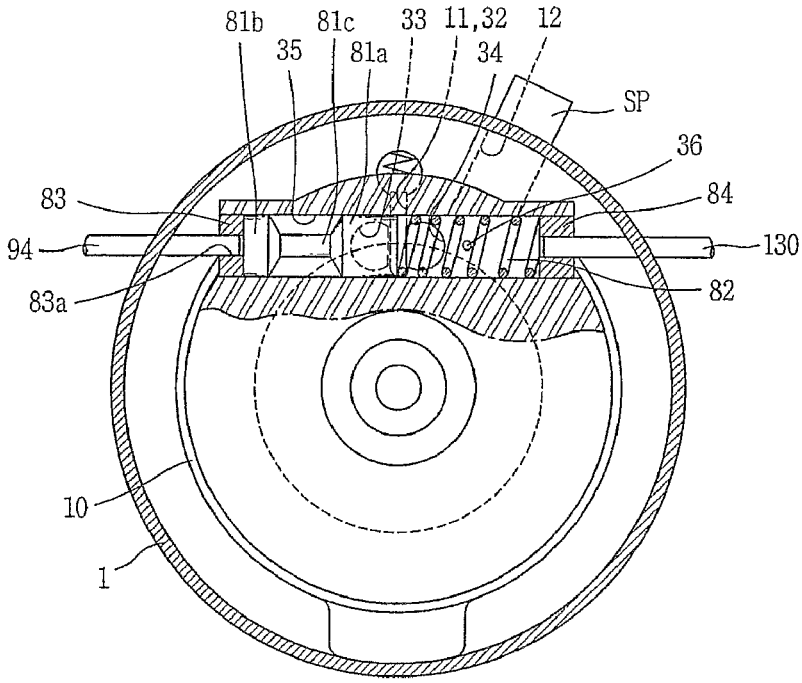
FIG. 8 is a sectional view showing another embodiment of the capacity varying unit of the capacity variable type rotary compressor according to the present invention.

Referring to FIGS. 7 and 8, as one embodiment of the pressure difference maintaining unit, a check valve 110 that constitutes a part of a first refrigerant flow controller is installed at the low pressure side of the system shown in FIG. 1, that is, between the evaporator 4 and the accumulator 5. On the contrary, a magnet valve (unidirectional solenoid valve) 120 that constitutes a part of a second refrigerant flow controller is installed between the condenser 2 and the expander (or evaporator) 3. As shown in FIG. 7, the low pressure connection pipe 93 is diverged from an inlet of the check valve 110, that is, a refrigerant pipe between the check valve 110 and the evaporator 4, and is connected to the low pressure side inlet 95*b* of the back pressure switching unit 90. Also, a bypass pipe 130 is diverged from the inlet of the check valve 110, and is connected to the low pressure side valve stopper 84 that shields the low pressure side of the capacity varying unit 80, that is, the low pressure side of the valve hole 35. In that case, the aforementioned pressure equalizing hole 36 is removed.

An operation of the pressure difference maintaining unit will be explained as follows.

Figure 9:
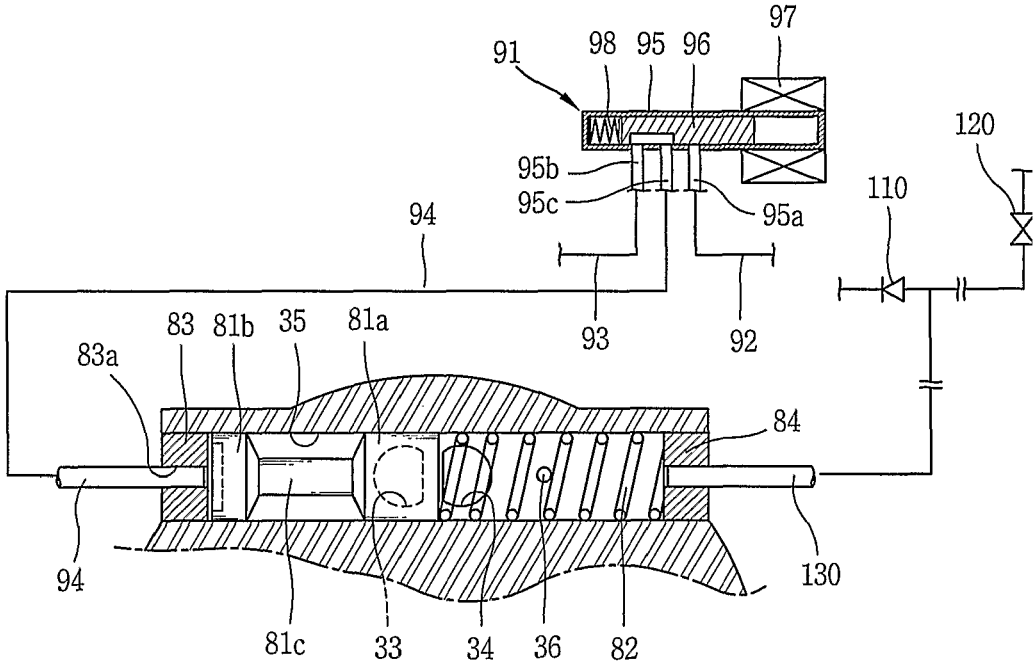
FIGS. 9 and 10 are sectional views respectively showing a power driving and a saving driving in the capacity variable type rotary compressor according to another embodiment of the present invention.

In case of the mode 1 driving, as shown in FIG. 9, when the compressor is driven under a state that the refrigerant pipe between the condenser 2 and the expander 3 is opened by turning off power applied to the magnet valve 120, a refrigerant of a high pressure discharged from the compressor passes through the condenser 2 and the magnet valve 120 and is sucked into the inlet 12 of the compressor via the expander 3, the evaporator 4, and the check valve 110, which is repeated. The back pressure switching unit 90 is also turned off and the low pressure connection pipe 93 is connected to the common connection pipe 94, so that the sliding valve 81 closes the high pressure side bypass hole 33. Accordingly, the compressor continuously performs a compression driving for implementing a cooling capability of 100%.

Figure 10:
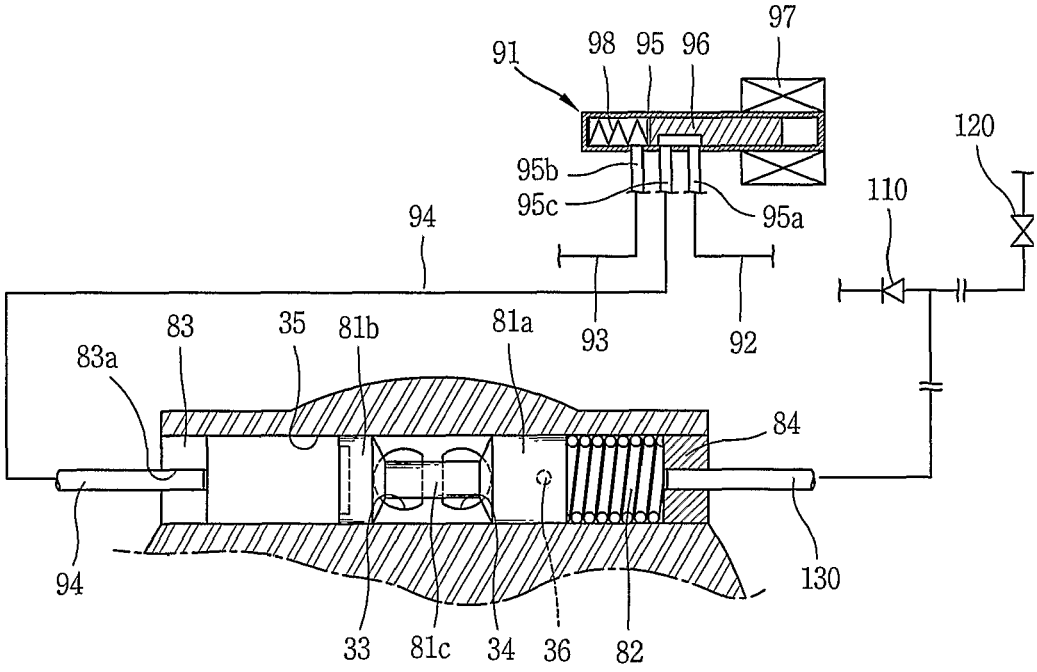
Figure 11:
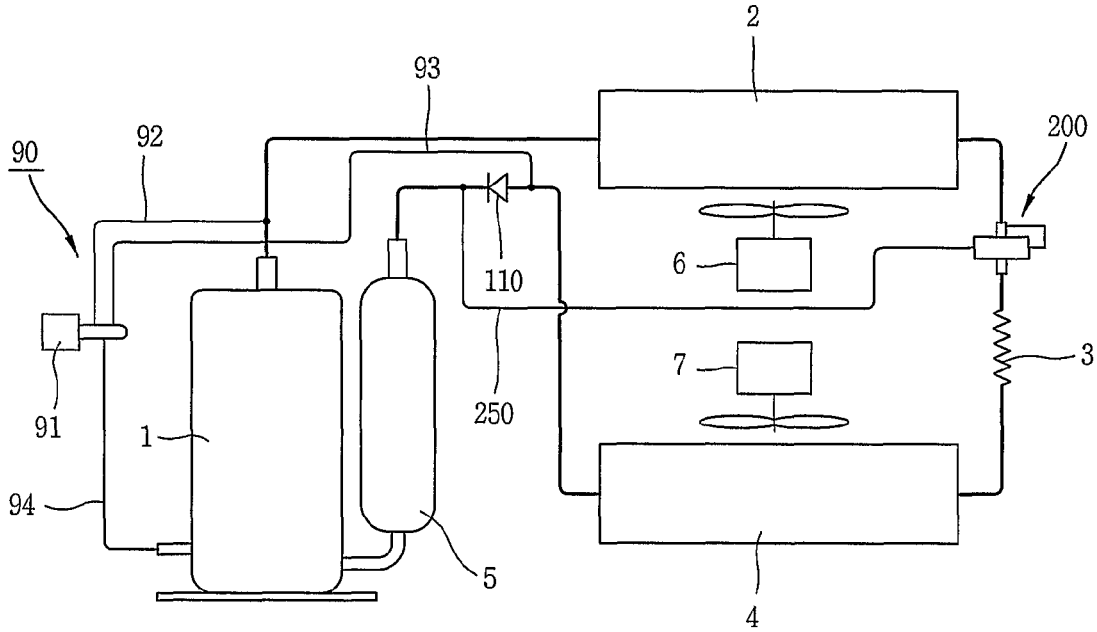
FIG. 11 is a piping diagram showing still another embodiment of the capacity variable type rotary compressor according to the present invention.
Figure 12:
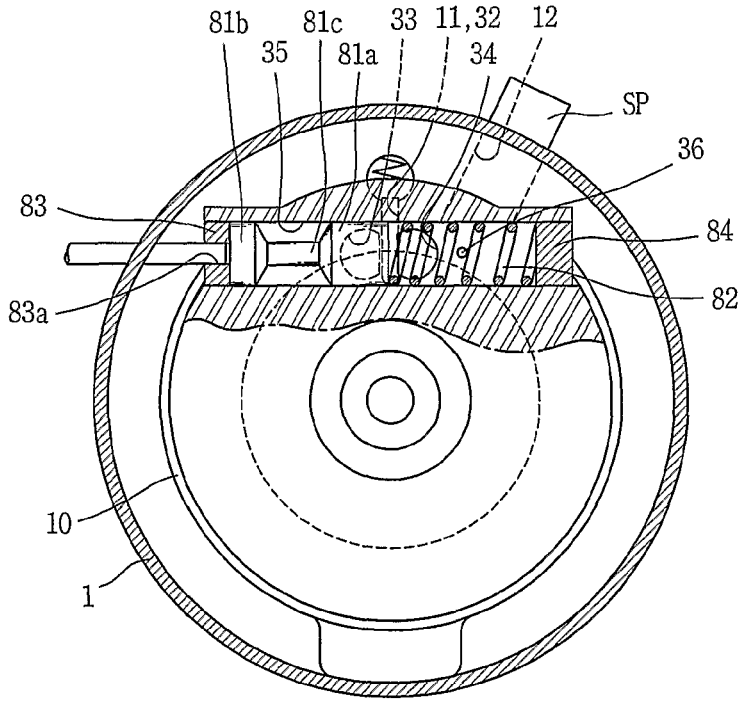
FIG. 12 is a sectional view showing still another embodiment of the capacity varying unit of the capacity variable type rotary compressor according to the present invention.

In case of the mode 0 driving, as shown in FIG. 10, the refrigerant pipe between the condenser 2 and the expander 3 is closed by turning on the magnet valve 120. At the same time, the back pressure switching unit 90 is also turned on, thereby connecting the high pressure connection pipe 92 to the common connection pipe 94. Accordingly, the sliding valve 81 overcomes the valve spring 82 and moves to the right side of the drawing, thereby opening the high pressure side bypass hole 33 and the low pressure side bypass hole 34 so as to be connected to each other.

Accordingly, the compressed gas of the cylinder 10 is excluded to the suction chamber V2 from the compression chamber V1, thereby performing a non-compression driving.

When the rotary compressor performs the mode 0 driving or is stopped, a low pressure atmosphere is entirely formed in the cylinder 10 and thereby the oil inside the casing 1 is fast introduced into the compression chamber of the cylinder 10 through a gap between the vane 60 and the vane slit 11 of the cylinder 10 or a gap between the rolling piston 50 and the bearings 20 and 30. Accordingly, the pressure inside the cylinder 10 is increased thereby to generate a backflow towards the accumulator 5. However, since the check valve 110 provided at the inlet of the accumulator 5 prevents the backflow, the pressure inside the accumulator 5 and the cylinder 10 becomes equal to the pressure inside the casing 1, that is, the pressure of the high pressure side of the system in a short time. Also, when the magnet valve 120 is closed, the compressor and the condenser 2 (or the inlet of the magnet valve) maintains a high pressure, and the evaporator (or the outlet of the magnet valve) 4 and the check valve 110 maintains a low pressure. The pressure difference is maintained for a long time until the temperature of the condenser 2 and the evaporator 4 becomes equal to a peripheral temperature, thereby maintaining the mode 0 driving for a long time (more than three minutes). Also, in case of stopping at least one of the blowing fan 6 of the condenser 2 and the blowing fan 7 of the evaporator 4 or lowering an air volume after switching the compressor into the mode 0 driving, the mode 0 driving state can be prolonged. Even if the magnet valve 120 is positioned at the outlet of the expander 3, the same effect is obtained.

FIGS. 11 to 14 show an automatic valve opened and closed by a pressure difference of a refrigerant, which replaces the magnet valve according to another embodiment of the present invention.

The automatic valve 200 comprises a control valve housing 210 installed in the middle of a refrigerant pipe L between the condenser outlet and the evaporator inlet, a control valve 220 slidably inserted into the control valve housing 210 for opening and closing the refrigerant pipe between the condenser outlet and the evaporator inlet by a pressure. difference between both ends thereof, a control valve spring 230 provided at one side of the control valve 220 and restored so that the control valve 220 can close the refrigerant pipe when the control valve has an equalized pressure at both sides thereof, a first bypass pipe 240 diverged from the condenser outlet and connected to one side of the control valve housing 210 so as to be connected to one side of the control valve 220, and a second bypass pipe 250 diverged from the refrigerant pipe between the compressor inlet and the check valve 110 and connected to another side of the control valve housing 210 so as to be connected to another side of the control valve 220.

The check valve 110 for preventing refrigerant gas or oil from backflowing from the compressor is installed at the refrigerant pipe between the evaporator 4 and the accumulator 5. The low pressure connection pipe 93 is connected between the check valve 110 and the evaporator 4, and the second bypass pipe 250 is connected between the check valve 110 and the accumulator 5.

The automatic valve has the following effects.

In case of the mode 1 driving, the first bypass pipe 240 is connected between the condenser outlet and the expansion valve 3. Accordingly, the first bypass pipe 240 always has a high pressure whereas the second bypass pipe 250 has a low pressure equal to an outlet pressure of the gas suction pipe SP or the evaporator 4. However, in case of the mode 0 driving or in case of stopping the compressor, the check valve 110 is closed and thereby the second bypass pipe 250 is switched into a high pressure.

Figure 13:
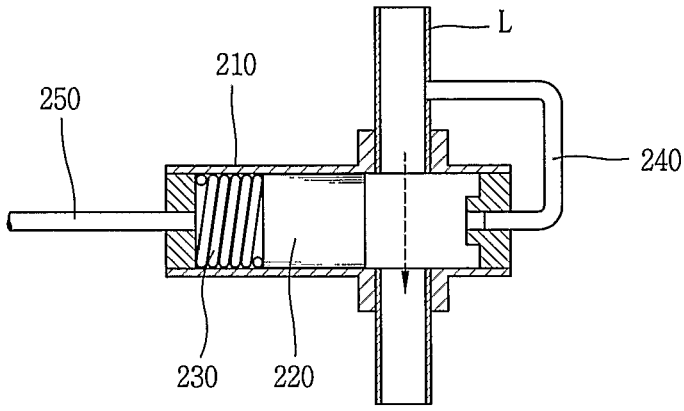
FIGS. 13 and 14 are sectional views respectively showing an operation of an automatic valve in the capacity variable type rotary compressor according to the present invention.

In case of the mode 1 driving, the second bypass pipe 250 has a low pressure whereas the first bypass pipe 240 has a high pressure. Accordingly, the control valve 220 moves towards the second bypass pipe 250, thereby opening the refrigerant pipe L between the condenser 2 and the expander 3 as shown in FIG. 13.

Figure 14:
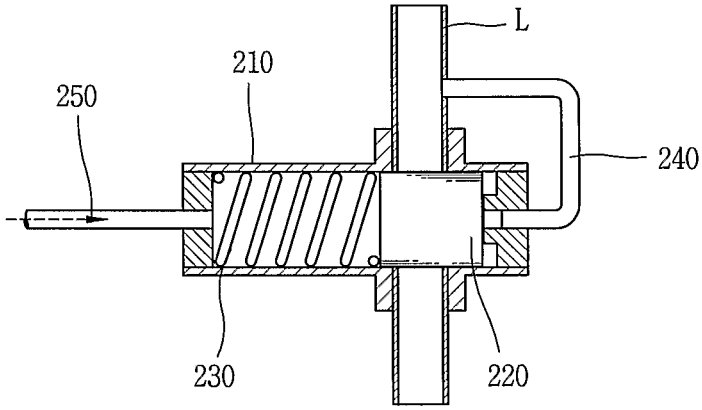

Then, in case of switching the mode 1 driving into the mode 0 driving or in case of stopping the compressor, the second bypass pipe 250 has a high pressure and thereby both ends of the control valve 220 have a high pressure. Accordingly, the control valve 220 moves towards the first bypass pipe 240 by the elastic force of the control valve spring 230, thereby closing the refrigerant pipe L between the condenser 2 and the expander 3 as shown in FIG. 14.

Then, in case of switching the mode 0 driving into the mode 1 driving or in case of switching the compressor into the mode 1 driving by re-operation, the second bypass pipe 250 has a low pressure. Accordingly, the refrigerant pipe L between the condenser 2 and the expander 3 is opened, and the check valve 110 is also opened, thereby maintaining a general refrigerating cycle and smoothly circulating refrigerant gas.

In case of using the automatic valve instead of the magnet valve, the system can be automatically opened and closed by a mode switching without using an electric circuit, thereby saving energy, enhancing a reliability, and reducing a fabrication cost.

The pressure difference maintaining unit mounted at an air conditioner to which the capacity variable type rotary compressor is applied has the following effects.

First, the mode 0 driving of the compressor can be maintained for a long time. Accordingly, a lower limit value for a cooling capability of the system can be small thereby to implement a system having a large degree of freedom for modulating a cooling capability. Also, the mode 1 driving and the mode 0 driving of the compressor need not to be frequently switched in order to switch a cooling capability, thereby preventing the life span of the back pressure switching unit 90 or the compressor from being decreased.

Second, it is easy to re-operate the compressor in the mode 0 driving after stopping the compressor. However, in case of performing the mode 0 driving for a long time (for example, more than 10 minutes), a pressure difference between a high pressure and a low pressure is not maintained, and thereby the compressor is operated after switching the mode 0 driving into the mode 1 driving. The system to which the automatic valve is applied has a small pressure difference, and is automatically opened as shown in FIG. 13, thereby fast performing a pressure equalization.

Third, if a compressor having no pressure difference maintaining unit is stopped, the compressor has to be in a wait mode until the system has an equalized pressure after a pressure difference is removed. However, the compressor having the pressure difference maintaining unit can be re-operated within a short time (10 seconds or 1 minute) if the compressor maintains the mode 0 driving or the compressor is switched into the mode 0 driving. Conversely, if the mode 0 driving of the compressor is maintained even if the compressor has been stopped for a long time, the compressor can be operated in the mode 0 driving. Also, a cooling capability can be more variously controlled by switching the cooling capability into zero by stopping the compressor.

Fourth, since the check valve 110 and the magnet valve 120 are fast closed during the mode 0 driving, a refrigerant does not flow from the condenser 2 to the evaporator 4 or gas does not backflow to the evaporator 4 from the compressor. Accordingly, there is no energy loss of the refrigerating cycle generated at the time of switching the mode 1 driving into the mode 0 driving, and the mode 0 driving is instantaneously switched into the mode 1 driving at the time of switching the mode 0 driving into the mode 1 driving thereby to enhance the system efficiency.

How long the mode 0 driving has to be maintained or whether the compressor can be operated in the mode 0 driving after being stopped, etc. are determined according to whether a pressure difference between a high pressure and a low pressure for maintaining the mode 0 driving is generated or not. The pressure difference is obtained by using a differential pressure sensor, and whether the pressure difference is generated or not is judged by detecting an operation duration time of the compressor after being switched into the mode 0 driving from the mode 1 driving, the time that the compressor has been stopped, and the temperature of the condenser and the evaporator. If the temperature of the condenser and the evaporator is within a preset range, it is judged that the pressure difference is generated. Among the above detection factors, the temperature of the condenser and the evaporator is the most advantageous in the economic aspect.

A process for controlling a cooling capability of the capacity variable type rotary compressor according to the present invention will be explained as follows.

When the compressor is operated, the system continues to perform a normal driving in the mode 1 driving due to a normal refrigerating cycle subsequent to an abnormal refrigerating cycle. When an indoor temperature approaches to a preset temperature, the cooling capability is gradually lowered since the cooling capability is excessive in the mode 1 driving thereby to reach the indoor temperature to the preset temperature. For example, in case of lowering the cooling capability (Qm) into 80%, a driving time ratio (m) between the mode 1 driving and the mode 0 driving is set to be 4:1.

That is, m=mode 1 driving/(mode 1 driving+mode 0 driving)=0.8

Cooling capability (Qm)=0.8×100%=80%

In case of lowering the cooling capability, for example, into 20%, m has to be set to be 0.2. The driving time ratio (m) between the mode 1 driving and the mode 0 driving has to be 1:4.

In case of using a mode S (stopping) driving, the mode 0 driving is substituted by the mode S driving. In case of controlling the compressor in the mode 0 driving, there is a component loss, a motor loss, and a gas resistance loss even under no-load state, and a consumption power more than 10% of that required in the mode 1 driving is necessary. However, the mode S driving has a zero loss since the compressor is stopped.

The method for controlling a cooling capability of an air conditioner to which the capacity variable type rotary compressor according to the present invention is applied will be explained as follows.

FIGS. 15 to 18 show a mode using method for controlling a cooling capability.

Figure 15:
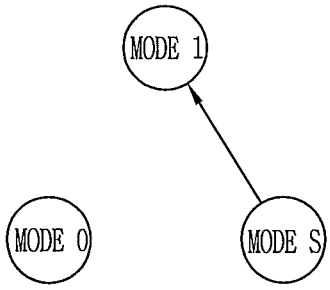
FIGS. 15 to 18 are free views showing a process for controlling a cooling capability by a pressure difference maintaining unit in the capacity variable type rotary compressor according to the present invention.

Referring to FIG. 15, the compressor stopped in the mode 1 driving is operated thereby to switch the compressor into the mode 1 driving from the mode S driving.

Figure 16:
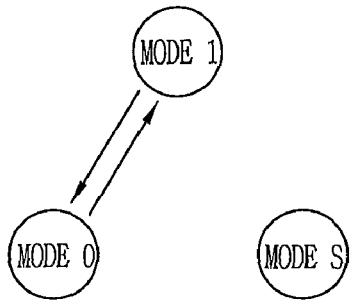

Then, when the mode 1 driving is continuously performed, the temperature and the pressure of a heat exchanger or the compressor, etc. of the system are stabilized. When the indoor temperature approaches to the preset temperature, the compressor is not stopped but a mode switching between the mode 1 driving and the mode 0 driving is repeatedly performed, thereby generating a small difference between the indoor temperature and the preset temperature. That is, the driving time ratio (m) between the mode 1 driving and the mode 0 driving is controlled as shown in FIG. 16, thereby controlling a cooling capability and thus stabilizing the indoor temperature into the preset temperature.

Figure 17:
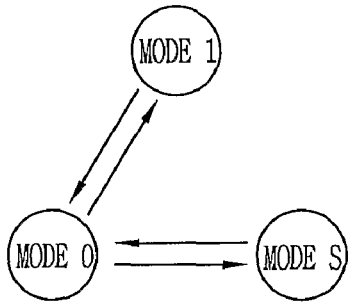

In case that the system is provided with the pressure maintaining unit, the compressor can be operated within a short time after being stopped. As shown in FIG. 17, the mode S driving is used instead of the mode 0 driving, and the mode 0 driving and the mode S driving are together used. That is, a process for inserting the mode 0 driving while performing a switching between the mode 1 driving and the mode 0 driving generates less vibration and enables an easy driving at the time of driving or stopping the compressor than a process for directly performing a switching between the mode 1 driving and the mode 0 driving.

Figure 18:
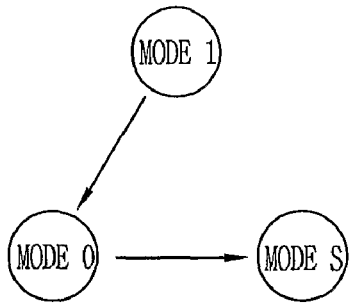

Also, in case of stopping the compressor, the compressor is directly stopped in the mode 0 driving as shown in FIG. 18. However, in case of the mode 1 driving, the compressor is switched into the mode 0 driving and then the compressor is turned off in order to reduce vibration generated when the compressor is stopped.

In the capacity variable type rotary compressor of the present invention, the mode switching is frequently performed between the mode 1 driving and the mode 0 driving, thereby controlling the cooling capability. Also, the mode S driving may be added to the mode 1 driving and the mode 0 driving, thereby performing a pulse capacity modulation. Besides, the cooling capability can be arbitrarily controlled within a range corresponding to 100% to 20% by controlling the driving time in each driving mode, thereby lowering the fabrication cost and enhancing the efficiency and the reliability than in the inverter rotary compressor.

The capacity variable type rotary compressor and the driving method thereof according to the present invention can be applied to a refrigerating cycle apparatus, a necessary component to home electronics, etc., and can be particularly applied to an air conditioner for efficiency.

As aforementioned, in the capacity variable type rotary compressor and the driving method thereof, the bypass holes for connecting the compression chamber and the suction chamber of the cylinder divided from each other by the vane are formed at the sub bearing, and the sliding valve for opening and closing the bypass holes is installed at the sub bearing. Also, the pressure difference maintaining unit for enabling the sliding valve to maintain a capacity exclusion driving is installed, thereby enhancing a cooling capability when the capacity exclusion driving of the compressor is performed. Also, since the capacity exclusion driving can be maintained for a long time, an air conditioner to which the present invention is applied can be variously controlled. Therefore, unnecessary power consumption of the compressor and the air conditioner to which the compressor is applied is prevented.

Also, since a back pressure of the sliding valve is fast and precisely switched by using the pilot valve having a cheap cost and a high reliability, the method of the present invention can be widely applied to a compressor or an air conditioner having a function for frequently varying a cooling capability. Therefore, the efficiency of the compressor or the air conditioner is prevented from being lowered.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

The invention claimed is:

1. A capacity variable type rotary compressor, comprising:

a casing having a gas suction pipe configured to be connected to an evaporator and a gas discharge pipe configured to be connected to a condenser;

a cylinder fixed in the casing, the cylinder having an inner space formed at a center thereof for compressing a refrigerant as a rolling piston performs an orbit motion, and having an inlet penetratingly formed at the inner space in a radial direction so as to be connected to the gas suction pipe, and having a vane slit formed in a radial direction so as to support a vane therein that divides the inner space into a compression chamber and a suction chamber by contacting the rolling piston in a radial direction;

a plurality of bearing plates for covering upper and lower sides of the cylinder and thereby sealing the inner space, a first of the plurality of bearing plates having a discharge port provided with a discharge valve connected to the inner space of the cylinder for discharging a compressed refrigerant, and a second of the plurality of bearing plates having a plurality of bypass holes formed therein that connect the compression chamber and the suction chamber of the cylinder divided from each other by the vane;

a capacity varying unit coupled to the second of the plurality of bearing plates for selectively connecting the plurality of bypass holes and thereby bypassing a part of a compressed refrigerant to the inlet of the compressor;

a back pressure switching unit that selectively supplies a different back pressure to the capacity varying unit so that the capacity varying unit can open or close the plurality of bypass holes according to a driving mode of the compressor; and a pressure difference maintaining unit that forcibly controls a refrigerant flow so that an opened state or a closed state of the capacity varying unit can be maintained for a certain time, wherein the back pressure switching unit comprises:

a switching valve assembly for determining a pressure of a pressure unit of a sliding valve of the capacity varying unit;

a high pressure connection pipe connected to a high pressure side inlet of the switching valve assembly for providing a high pressure atmosphere;

a low pressure connection pipe connected to a low pressure side inlet of the switching valve assembly for providing a low pressure atmosphere; and a common connection pipe for selectively supplying a high pressure atmosphere or a low pressure atmosphere to the pressure unit of the sliding valve by connecting a common side outlet of the switching valve assembly to a valve hole formed in the second of the plurality of bearing plates, and wherein the switching valve assembly comprises:

a switching valve housing for forming the high pressure side inlet, the low pressure side inlet, and the common side outlet;

a switching valve slidably coupled to an inside of the switching valve housing for selectively connecting the high pressure side inlet and the common side outlet or the low pressure side inlet and the common side outlet;

an electromagnet installed at one side of the switching valve housing for moving the switching valve by an applied power; and an elastic member for restoring the switching valve when the power applied to the electromagnet is cut off, and wherein the pressure difference maintaining unit comprises:

a first refrigerant flow controller installed between an inlet of the compressor and an outlet of the evaporator, the first refrigerant flow controller forming a low pressure by opening a first refrigerant pipe between the compressor and the evaporator when the compressor is operated and the plurality of bypass holes are closed, and forming a high pressure by closing the first refrigerant pipe when the plurality of bypass holes are opened, the first refrigerant flow controller comprising:

a check valve installed in a middle part of the first refrigerant pipe between the compressor inlet and the evaporator outlet, wherein the check valve is automatically opened or closed based on a pressure difference between the compressor inlet and the evaporator outlet so as to prevent a backflow of refrigerant; and a low pressure connection pipe diverged from an inlet of the check valve and connected to the low pressure side inlet of the switching valve assembly of the back pressure switching unit; and a second refrigerant flow controller installed between an inlet of the evaporator and an outlet of the condenser, the second refrigerant flow controller forming a high pressure by opening a second refrigerant pipe between the evaporator and the condenser when the compressor is operated and the plurality of bypass holes are closed, and forming a low pressure by closing the second refrigerant pipe when the plurality of bypass holes are opened, the second refrigerant flow controller comprising:

a control valve housing installed in a middle part of the second refrigerant pipe between the condenser outlet and the evaporator inlet;

a control valve slidably inserted into the control valve housing for opening and closing the second refrigerant pipe between the condenser outlet and the evaporator inlet based a pressure difference between two opposite ends thereof;

an elastic member provided at one side of the control valve that restores the control valve to close the second refrigerant pipe when the control valve has an equalized pressure at two opposite sides thereof;

a first bypass pipe diverged from the condenser outlet and connected to one side of the control valve via one side of the control valve housing; and a second bypass pipe diverged from a refrigerant pipe positioned between the compressor inlet and the check valve so as to be connected to another side of the control valve via another side of the control valve housing.

2. The rotary compressor of claim 1, wherein one of the plurality of bypass holes that is positioned at a high pressure side is formed on the same shaft as that of the discharge port, and another of the plurality of bypass holes is formed so as to overlap with the inlet.

3. The rotary compressor of claim 1, wherein the valve hole formed in the second of the plurality of bearing plates connects the plurality of bypass holes to each other, and the capacity varying unit is positioned at the valve hole.

4. The rotary compressor of claim 3, wherein the sliding valve of the capacity varying unit is slidably inserted into the valve hole and is moved in the valve hole by a pressure difference due to the back pressure switching unit, for opening and closing the plurality of bypass holes, wherein the capacity varying unit further comprises:

at least one valve spring for elastically supporting a motion direction of the sliding valve and moving the sliding valve in a position to close the plurality of bypass holes when both ends of the sliding valve have the same pressure; and a plurality of valve stoppers for closing the valve hole in order to prevent the sliding valve from being separated from the valve hole.

5. The rotary compressor of claim 4, wherein the sliding valve comprises:

a plurality of pressure units respectively positioned at both sides of the plurality of bypass holes and slidably contacting an inner circumferential surface of the valve hole, for opening and closing at least one of the plurality of bypass holes by receiving a pressure from the back pressure switching unit; and a connection unit for connecting the pressure units to each other, and having a gas passage for connecting the plurality of bypass holes to each other between an outer circumferential surface thereof and the valve hole.

6. The rotary compressor of claim 5, wherein the valve hole is provided with a back pressure hole connected to an outlet of the back pressure switching unit on at least one of two side surfaces thereof.

7. The rotary compressor of claim 6, wherein another side of the two side surfaces of the valve hole connects the bypass hole positioned at a low pressure side to the inlet of the cylinder.

8. The rotary compressor of claim 6, wherein another side of the two side surfaces of the valve hole is connected to a middle part of a refrigerant pipe having a low pressure by the pressure difference maintaining unit.

9. The rotary compressor of claim 1, wherein the high pressure connection pipe is connected to a middle part of the gas discharge pipe.

10. The rotary compressor of claim 1, wherein the high pressure connection pipe is connected to a lower portion of the casing in order to be soaked in oil filled in the casing.

11. The rotary compressor of claim 1, wherein the common connection pipe is formed of a tubule.

* * * * *